United States Patent [19]

Plaza et al.

[11] 4,222,673

[45] Sep. 16, 1980

[54] PRINT HEAD CARRIAGE ASSEMBLY FOR SERIAL PRINTERS

[75] Inventors: Mario G. Plaza, Fremont; Helmut K. Waibel, Hayward, both of Calif.

[73] Assignee: Durango Systems, Inc., San Jose, Calif.

[21] Appl. No.: 943,790

[22] Filed: Sep. 20, 1978

[51] Int. Cl.[3] ..... B41J 11/00; B41J 25/30

[52] U.S. Cl. ..... 400/56; 400/57; 400/59; 400/352

[58] Field of Search ..... 400/55, 57, 59, 124, 400/320, 328, 352

[56] References Cited

U.S. PATENT DOCUMENTS

| | | | |
|---|---|---|---|
| 3,908,819 | 9/1975 | Gely | 400/242 |
| 3,960,256 | 6/1976 | Bickoff et al. | 400/59 X |
| 3,990,560 | 11/1976 | Pavliscak et al. | 400/56 |
| 4,134,695 | 1/1979 | Randolph | 400/59 X |

FOREIGN PATENT DOCUMENTS

| | | | |
|---|---|---|---|
| 2321988 | 12/1973 | Fed. Rep. of Germany | 400/56 |
| 2239117 | 2/1974 | Fed. Rep. of Germany | 400/55 |
| 2318947 | 10/1974 | Fed. Rep. of Germany | 400/56 |
| 2516149 | 10/1976 | Fed. Rep. of Germany | 400/124 |

*Primary Examiner*—Paul T. Sewell

*Attorney, Agent, or Firm*—Thomas E. Schatzel

[57] ABSTRACT

A print head carriage assembly for a serial printer apparatus, the carriage including a platform having two parallel channels extending laterally through the frame member for receiving self-aligning bearings and carriage guide rails; a central seat within the platform for seating the housing of a matrix print head with the longitudinal dimension of the print head oriented normal to the longitudinal axes of the channels, locking means for securing the matrix print head in place about said central seat with the neck of the head extending substantially normal to the axes of the channels, manifold adjustment means for adjusting the position of the head within the seat relative to the axes of the channels; and means for engaging the platform to a drive means for driving said platform laterally along said guide rails.

14 Claims, 7 Drawing Figures

PRINT HEAD CARRIAGE ASSEMBLY FOR SERIAL PRINTERS

BACKGROUND OF THE INVENTION

1. Field of the Invention

The present invention relates generally to printing apparatus and more particularly to carriage assemblies for carrying the print heads of high-speed serial printers.

2. Description of the Prior Art

High-speed serial printers are well known in the art and have been developed to accommodate the high output speed of information which can be delivered by high-speed data processing systems. Also, print heads which can accommodate high-speed electronics are well known in the prior art. For example, serial printers employing wire matrix ballistic impact print heads capable for providing multiple hard copies of information at relatively high speed are known. Such printers are characterized in that for each print cycle, the printer uses an array of wire styli to print selective combinations of dots serially onto the recording medium (e.g., paper) so that as the recording medium is moved laterally relative to the print head, successive print cycles generate alphanumeric characters or other informational indicia. Wire matrix ballistic impact print heads typically use a separate electromagnetic actuator for each stylus within the print head. Commonly, there are approximately nine styli in each print head such that the electromagnets are arranged in a circular pattern with the styli extending therefrom a substantial distance to convert the circular orientation at the actuators to a linear pattern at the terminating ends. As a result, the head has a relatively long neck portion.

As high-speed serial printers become more widely used and the demands increase for printing apparatus capable of accommodating larger volumes of information at faster rates, it becomes desirable to have improved carriage means for carrying the print head. For example, demands exist for a carriage that provides for rapid and easy installation of the print head so that the operator of the printer can rapidly and quickly remove and/or insert the print head for repair, replacement and/or cleaning. At the same time, it is necessary that the carriage be such that it can travel at very high speeds and withstand substantial impact as it carries the head laterally forward and in reverse directions across the print medium. It is also necessary that the head be secured to the carriage such that it does not shift in its position relative to the platen during operation. Furthermore, as the demands for data processing equipment continually increase, it is essential to develop printers which are economical and capable of mass production.

SUMMARY OF THE PRESENT INVENTION

It is an object of the present invention to provide a carriage assembly for a high-speed printer wherein the print head may be quickly and easily inserted and/or removed therefrom without special tools.

It is a further object of the present invention to provide a print head carriage assembly which is of simple design and economical to produce.

It is a further object of the present invention to provide a print head carriage assembly wherein the position of the print head relative to the platen may be adjusted to accommodate print mediums of various thickness and/or multiple copies.

It is a further object of the present invention to provide a print head carriage assembly for a high-speed printer wherein the carriage platform primarily comprises two mating parts of duplicate structure and providing features for self-aligning on the platform on carriage rails.

Briefly, the preferred embodiment of the head carriage includes a platform comprising two duplicate segments which, when aligned in a face-to-face abutting relationship, establish a central opening symmetrical about a longitudinal center line. The opening forms a central seat for receiving the electromagnetic actuator section of a wire matrix ballistic impact print head. The segments further form a first and second channel each extending laterally across the segments and normal to the longitudinal center line of the respective carriage segments to receive self-aligning journal bearings about a pair of parallel guide rails. At least one of the segments includes a simple fastening means for locking a bracket coupled to the matrix print head in place to the platform and within the seat with the neck of the matrix print head projecting longitudinally substantially normal to the channels such that the terminal end of the matrix print head is adjacent to the platen of the printers. A manifold adjustment means is further included for adjusting the locked position of the electromagnetic actuators of the head within the seat so as to adjust the position between the terminal end of the matrix head assembly and the platen to accommodate a printing medium of multiple copies or various thicknesses.

The preferred embodiment provides a carriage structure wherein the print head with mounting bracket can be rapidly and easily installed or removed from the platform by merely rotating the single fastening means and lifting the bracket. At the same time, the platform structure is of simplified configuration wherein the bottom half and the upper half segments are duplicates such that manufacturing procedures of the parts can be simplified; parts inventory for repair and manufacture is reduced relative to structures requiring many different parts; assembly procedures are simplified; and maintenance is simplified. The bracket may be pivoted about one point on the platform so that the manifold adjustment means provides for a simple and rapid means for adjusting the position of the terminal end at the head dependent upon the number of copies to be printed and/or the thickness of the print medium.

These and other objects and advantages of the present invention will no doubt become apparent after a reading of the following detailed description of the preferred embodiment which is illustrated in the several figures of the drawing.

IN THE DRAWING

DETAILED DESCRIPTION OF THE PREFERRED EMBODIMENT

Figure 1:
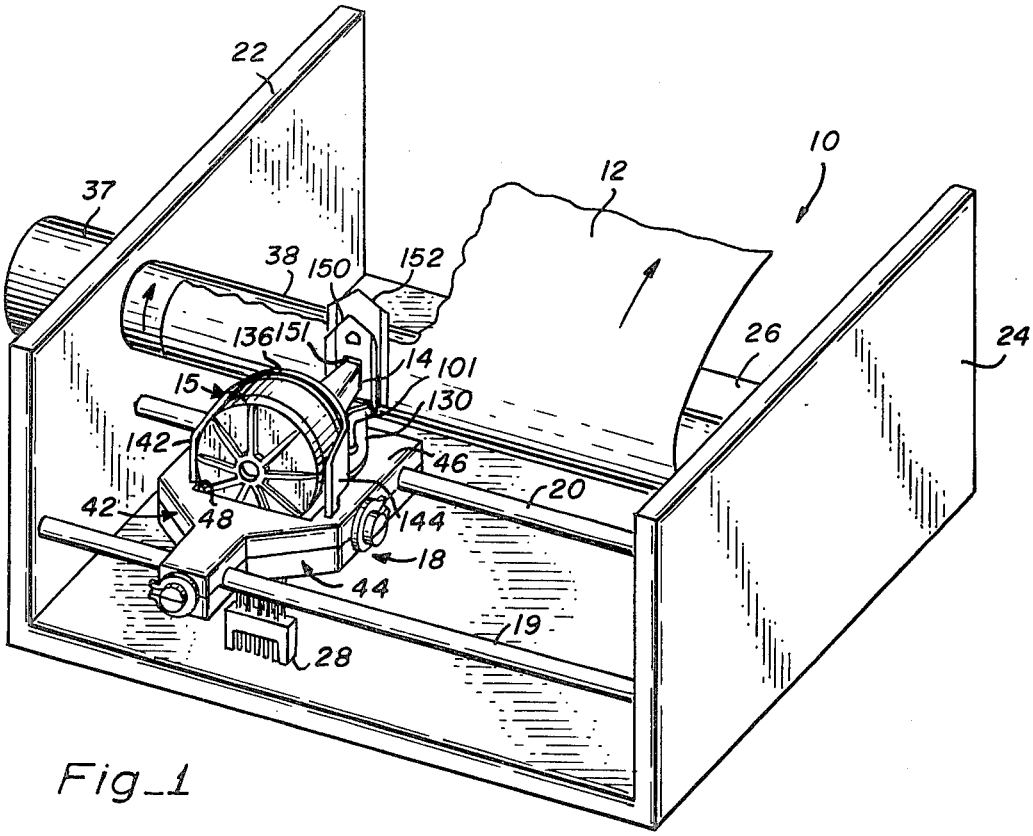
FIG. 1 is a perspective view of a partial serial printer housing with a carriage of the present invention for carrying a matrix print head.

FIG. 1 shows a perspective sketch of parts of a high-speed serial printer housing (without a keyboard) referred to by general reference character 10, to generally illustrate the setting of the present invention. In operation the printer prints on a print medium, e.g., paper 12, information from a print head 14. The print head 14 prints characters by using a combination of dots in columns with the columns being printed serially as the head is moved laterally relative to the paper 12. Frequently, the head prints in both lateral directions at high rates. For example, printers capable of printing 165 characters per second in both directions are known. As illustrated by FIG. 1, the paper 12 is transported past the terminal end of the print head 14. The print head 14 is mounted on a print head mounting bracket 15 which in turn is supported by a carriage platform 18 which is in turn supported by a pair of parallel carriage guide rails 19 and 20. The carriage guide rails 19 and 20 are supported by a pair of side plates 22 and 24 projecting from a base plate 26. Information to print head 14 is received through a nine-wire bus 28.

Figure 2:
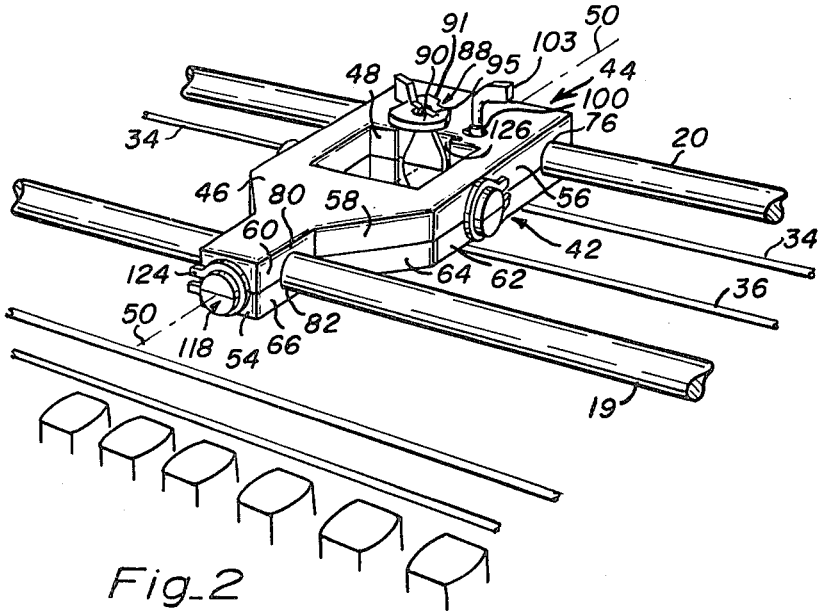
FIG. 2 is a perspective view of the carriage illustrated in FIG. 1 with the matrix print head and bracket removed.

The carriage 18 is driven laterally across the guide rails 19 and 20 by a drive cable mechanism illustrated in the form of cables 34 and 36 (see FIG. 2). The cables 34 and 36 are anchored to the carriage 18 and driven by a motor (not shown) to transport the carriage laterally back and forth along the guide rails 19 and 20 as individual characters and lines are printed on the print medium 12. Likewise, the print medium 12 is driven in steps to advance the paper as each line of print is completed. For example, a step motor 37 may be coupled to a roller platen 38 to advance the paper 12 in controlled steps.

FIGS. 2–6 further depict the print head carriage assembly 18 in greater detail. The carriage assembly 18 comprises two duplicate platform segments 42 and 44 which when placed in face-to-face abutment form the bottom half and top half respectively of the carriage platform. The segments 42 and 44 each have a top planar surface 46 and establish a central rectangular opening 48 which is symmetrical about a center line 50. Each of the segments 42 and 44 have a vertical front end wall 52 (see FIG. 3) and a vertical rear end wall 54 which are symmetrical about the center line 50. Joined to and perpendicular with the front end wall 52 is a sidewall 56 which extends to a vertical diagonal wall 58 extending to a wall 60 which is perpendicular to the end wall 54. A second sidewall 62 identical to the sidewall 56 is joined to and perpendicular to the front end wall 52 and tied to a diagonal wall 64, which is identical to the wall 58. The wall 64 joins a wall 66, identical to the wall 60, and which is normal to the rear end wall 54. The center line 50 bisects the end walls 52 and 54 such that the outer peripheral walls of the housings 42 and 44 are symmetrical about the center line 50.

Figure 7:
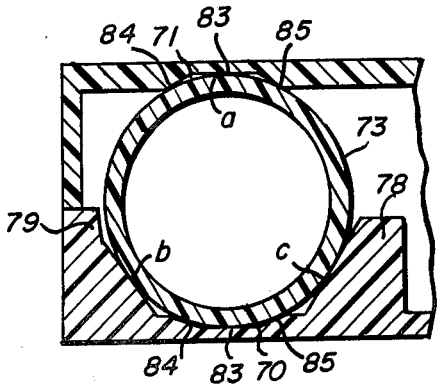
FIG. 7 is a cross-sectional view taken along the line 7—7 of FIG. 3 illustrating a journal bearing in a bearing seat.

The platform segments 42 and 44 each have a flat inside surface 68 (see FIG. 3) which is the opposing side of the outer flat planar surface 46. About the inside surface 68 are three bearings seats 70, 71 and 72 for receiving a hollow cylindrical bearing 73. The bearing seat 70 is adjacent to sidewall 56 and is in axial alignment with the bearing seat 71 which is adjacent to the sidewall 62. The seat 72 is parallel with the seats 70 and 71 and intermediate walls 60 and 66. The sidewall 56 has a semicircular opening 74 adjacent to and in axial alignment with the seats 70 and 71. Similarly, the sidewall 62 has a semicircular opening 75 adjacent to and in axial alignment with the seats 70 and 71. Adjacent to and coaxial with the bearing seat 72 are semicircular openings 76 and 77 in the walls 60 and 66, respectively. The bearing seats 70, 71 and 72 are designed to each receive the cylindrical bearing 73 which is designed to encircle the carriage guide rails 19 and 20 and to form a smooth bearing surface intermediate the guide rails and the carriage platform segments. A pair of tapered bosses 78 and 79 adjacent to the seat 70 and opening 74 are provided. The bearings 73, when placed in the seats 70 and 71, interface with bosses 78 and 79 to make two-point contact. As further illustrated in FIGS. 2 and 7, the seats 70, 71 and 73 each have a planar surface 83 and two tapered side surfaces 84 and 85. With the platform segments 42 and 44 in face-to-face alignment, the seat 70 of segment 42 aligns with the sea 71 of the segment 44 and vice versa. Thus, the bearing 73 in each seat makes contact with the surface 83 of the seat 71 while simultaneously in contact with the bosses 78 and 79 of seat 70, as illustrated by points "a", "b" and "c" in FIG. 7. Thus, the bearings 73 make three-point contact and are self-aligning relative to the guide rail 20 when mounted.

A circular opening 86, the axis of which lies on and is perpendicular to the center line 50, is included in each platform segment 42 and 44. When the segments 42 and 44 are placed in face-to-face relationship, the openings 86 receive a central circular detent 88 which carries a pair of tabs 90 and 91. The detent 88 is rotatable about its axis 92 which is coaxial with the openings 86. A coil spring 93 extends along the axis 92 and is anchored to the detent 88 by a cross pin 94 in a seat 95. Thus, the detent 88 is anchored in the openings 86 and rotatable about its axis 92. The tabs 90 and 91, as hereafter described, make frictional contact with the print head mounting bracket 15 when in one position, and clear the bracket when in another position.

Figure 3:
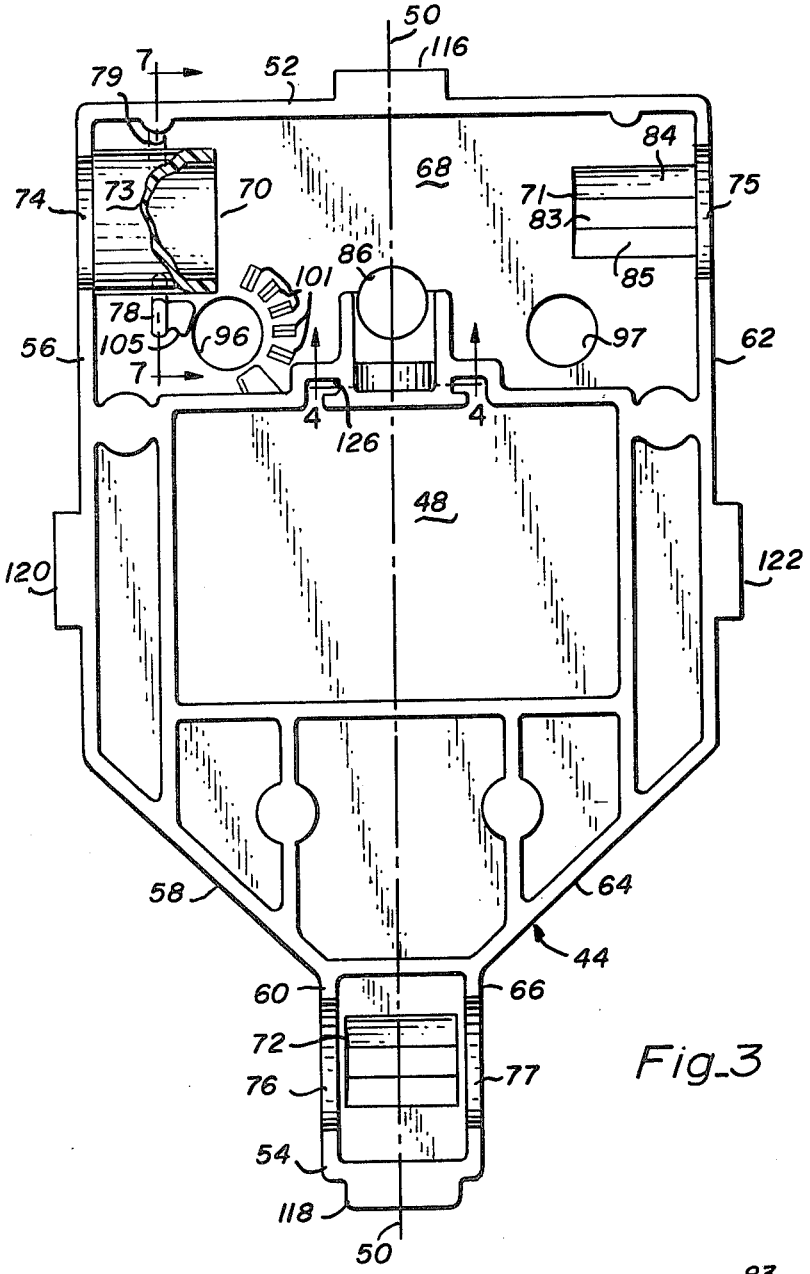
FIG. 3 is an elevational view of the interior of one of the platform segments of the carriage illustrated in FIGS. 1 and 2.
Figure 5:
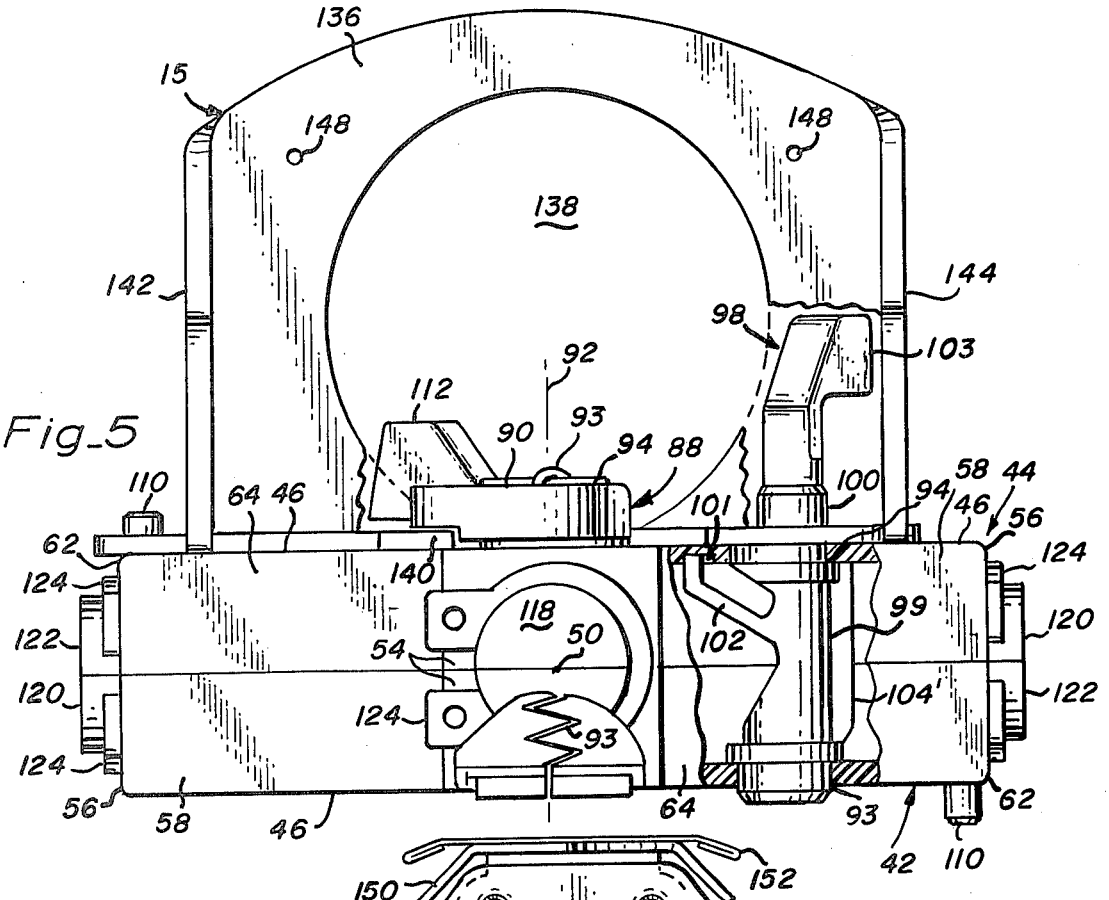
FIG. 5 is a partially broken away end view of the assembled carriage illustrated in FIGS. 1 and 2.
Figure 6:
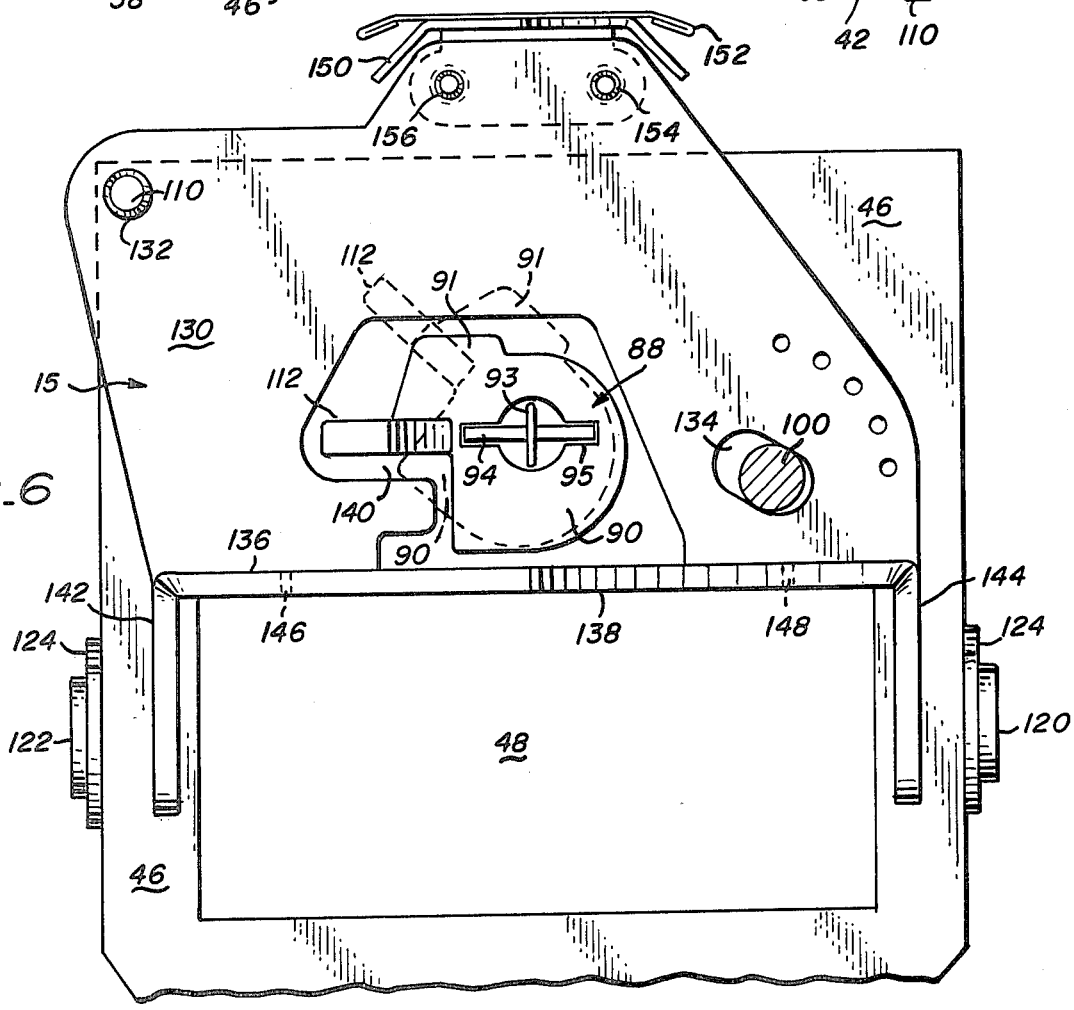
FIG. 6 is a top view of the head mounting bracket on the carriage with the head removed.

The carriage platforms 42 and 44 each include a pair of openings 96 and 97 on opposing sides of the opening 86 as depicted in FIG. 3. The openings 96 and 97 are of the same radius, in the lateral alignment with each other and equal distance from the center line 50. Thus, when the two segments 42 and 44 are placed in face-to-face abutment, the opening 96 of one platform aligns with the opening 97 of the other platform for receiving a manifold 98 having a shaft 99 coaxial with the aligned openings 96 and 97 as illustrated in FIG. 5. Projecting from the upper surface of the shaft 99 is a manifold shaft 100 which is eccentric to the axis of the shaft 99 and the openings 96 and 97. As further illustrated in FIG. 3, adjacent to the opening 96 about the inner surface 68 and arranged in an arcuate pattern coaxial with opening 96 are a plurality of indents 101. As depicted in FIG. 5, projecting from the shaft 99 is an arm 102 having a terminal end at a radial distance coinciding with the radial placement of the indents 101. Projecting over the top surface and extending from the eccentric shaft 100 is a handle 103. Thus, as the handle 103 is turned, the exterior shaft 100 assumes an eccentric path relative to the axis of the shaft 99. At the same time, the arm 102 frictionally engages one of the indents 101 depending on the rotational position of the handle 103, which indents serve as a temporary stop. As further illustrated in FIG. 5, the shaft 99 has a raised surface 104 projecting radially from the shaft 99. As further illustrated in FIG. 3, adjacent to the aperture 94 is a stop base 105. The interaction of the projection 104 and stop 105 limits the amount of potential rotation of the shaft 99 and thus the handle 103.

Also projecting from the top surface 46 of the carriage segments 42 and 44 is a cylindrical boss 110. As hereafter discussed, the boss 110 engages and serves as a pivot point for the bracket 15.

Projecting from the end wall surface 52 and 54 of each segment is a semicircular protrusion 116 and 118, respectively, each of which is coaxial with center line 50. Similarly projecting from the side walls 56 and 62 are similar semicircular protrusions 120 and 122, respectively, and coaxial with one another. Thus, with the segments 42 and 44 placed in face-to-face abutting relationship, the semicircular protrusions 116 are in alignment and establish a complete circular protrusion. Similarly, each pair of semicircular protrusions 118, 120 and 122 are in alignment and form similar circular protrusions. To secure the two platform segments 42 and 44 in place, a set of four C-shaped spring clamps 124 are used with each frictionally urged over each of the formed circular protrusions 116, 118, 120 and 122. With the C-shaped spring clamps 124 in place, the platform segments 42 and 44 are locked in abutting face-to-face relationship and form a carriage with the detent 88 and manifold shaft 100 in place.

Figure 4:
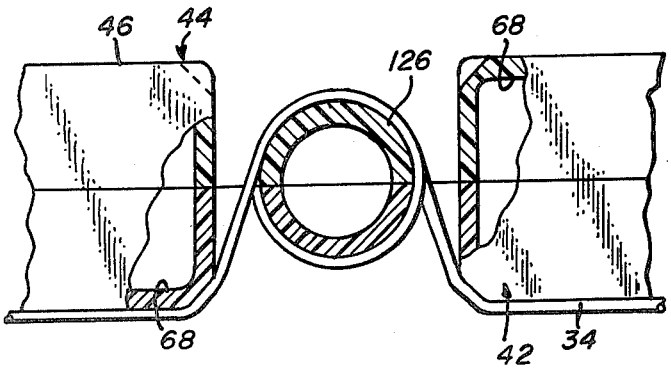
FIG. 4 is a cross-sectional view taken along the line 4—4 of FIG. 3 illustrating coupling of the carriage to a drive cable.

Also about the front wall of the central opening 48 is a semicircular groove 126 coaxial with the center line 50. The groove 126 is adapted such that when the platform segments 42 and 44 are in face-to-face abutment, the composite groove 126 receives and anchors the drive cable about the center line 50 as illustrated in FIG. 4. With the cable 34 wrapped in the groove 126, the cable 34 may be driven to pull the carriage assembly 18 along the rails 19 and 20.

When installing the print head carriage 18 to the printer 10, the guide rails 19 and 20 are released from one sidewall 22 or 24. Then the platform is merely slid in place with the rails 19 and 20 projecting through the journal bearings 73 seated in the seats 70, 71 and 72 through the openings 74, 75, 76 and 77. The drive cable 34 is then anchored in place about the groove 126.

The mounting bracket 15 has a horizontal planar plate 130 having a circular aperture 132 in one corner to couple with the boss 110 of the carriage segment 44. An oblong aperture 134 is provided to align within the manifold shaft 100 of the manifold member 98. The minor diameter of the oblong aperture 134 is approximately equal to the diameter of the shaft 100 such that the shaft 100 can fit snugly within the aperture 134. A vertical planar wall plate 136 projects from and normal to the plate 130. The wall plate 136 has a circular opening 138 to allow the neck of the print head 14 to project therethrough. About the intersection of the plates 130 and 136 is a P-shaped opening 140 which is of sufficient size to allow the detent 88 to project therethrough when the boss 110 is engaged about the aperture 132, and the manifold shaft 100 projects through the oblong aperture 134. A pair of sidewalls 142 and 144 project from opposing sides of the front vertical plate 136. The print head 14 is secured to the plate 136 by a pair of fastening pins, e.g., screws in screw holes 146 and 148 in the plate 136.

As best illustrated in FIG. 5, the detent 88 may be rotated so that once the plate 130 is in place, the tabs 90 and 91 simultaneously engage the plate 130. When engaged, spring 93 biases the detent 88 against the plate 130 at the interface of the tabs 90 and 91. Once the bracket 15 is in place and the tabs 90 and 91 of the detent 88 in engagement, to vary the distance of the head 14 and bracket 15 relative to the platen, the manifold member 98 is rotated by applying pressure to the tab 103. As the shaft 100 rotates, due to its eccentricity, it applies pressure against the sidewalls of the oblong aperture 134 which in turn cause the plate to pivot about the boss 110. Thus, vernier positioning may be realized to accommodate various thicknesses of print medium 12 or multiple copies. The indents 101 interacting with the arm 102 provides for calibration of the manifold adjustments.

A ribbon deflector 150 with an opening 151 and a paper deflector 152 with an opening aligned with opening 151 are mounted to the front of the plate 130 by a pair of screws 154 and 156. The ribbon may pass intermediate the deflectors 150 and 152 with the openings aligned with the end of the head.

While for the sake of clearness and in order to disclose the invention so that the same can be readily understood, a specific embodiment has been described and illustrated, it is to be understood that the present invention is not limited to the specific means disclosed. It may be embodied in other ways that will suggest themselves to persons skilled in the art. It is believed that this invention is new and that all such changes that come within the scope of the following claims are to be considered to be part of this invention.

What is claimed is:

1. In a printer apparatus having a print head mounted to a carriage assembly with said print head adapted to be oriented normal to a print medium, a platen about which is wrapped said print medium, and at least one guide rail adapted to guide said carriage assembly in a motion substantially parallel to said platen, the improvement in a print head carriage assembly for said printer apparatus, comprising:

a platform member having a top surface and a first channel extending laterally side-to-side of the platform member for receiving said guide rail, a central seat within the platform member for seating the housing of said print head with said print head oriented normal to said platen so as to permit said print head to print upon said print medium, wherein said platform member further comprises a first and a second carriage segment which are duplicates of one another and aligned in face-to-face abutting relationship, each of said first and second carriage segments having a central opening symmetrical about a longitudinal center line of the respective segment to form said central seat, each of said first and second carriage segments forming a first groove extending laterally across the segment and normal to said longitudinal center line of the respective carriage segment to form said first channel, means for securing said print head in place to the platform member when said print head is seated within the central seat and oriented normal to said platen, said means for securing said print head further including a clamp pivotable about a post anchored about the top surface of one of said carriage segments and having an axis normal to the axis of said first channel, said clamp forming a tab over the top surface of the carriage and pivotable between a first position adapted to clamp said print head and a second position remote from said print head whereby the tab may be rotated in and out of engagement with said print head when said print head is seated in the central opening, manifold adjustment means for adjusting the position of said print head within the central seat with respect to the perpendicular distance between said print head and said first channel, and fastening means for fastening the first and second carriage segments in aligned face-to-face relationship, whereby the central opening provides clearance to receive said print head with said print head supported by one of said carriage segments.

2. The improvement in a print head carriage assembly of claim 1 wherein the manifold adjustment means includes an eccentric pivotable arm projecting above the top surface of the platform member and engaged to a shaft supported by the platform member, said eccentric pivotable arm being positioned to couple with said print head housing seated within the central opening, whereby as said eccentric pivotable arm is pivoted, it adjusts the position of said print head perpendicular to said longitudinal axis of said first channel.

3. The improvement in a print head carriage assembly of claim 2 wherein the carriage segments include means for anchoring carriage drive cables whereby the platform member may be moved along said guide track responsive to said drive cables.

4. The improvement in a print head carriage assembly of claim 1 wherein, the platform member includes a pair of bearing seats about each end of said first channel, and including a pair of bearings with each bearing positioned in one of said bearing seats and making contact at a plurality of points with said seat whereby each bearing is pivotable about its axis relative to the axis of said first channel.

5. The improvement in a print head carriage assembly of claim 2 further including:

a head-mounting bracket adapted to substantially rigidly mount said print head to the top surface of said platform member, the bracket having a first surface member having a sloted opening for engaging said manifold adjustment means, a coupling means for engaging the first surface member about the top surface of the platform member with said first surface member being pivotable about said coupling means, a second surface member rigidly attached to said first surface member adapted to receive said print head, and means for rigidly fastening said print head to said second surface member.

6. The improvement in a print head carriage assembly of claim 5 wherein the securing means includes a detent member anchored to the platform member and pivotable about an axis normal to the axis of said first channel, said detent member having projecting tab members which intersect with said head-mounting bracket as said detent member is pivoted.

7. The improvement in a print head carriage assembly of claim 6 wherein the manifold adjustment means includes a first pivotable shaft projecting above the top surface of the carriage engaged to and eccentric to a second shaft supported by the platform member, said first pivotable arm being positioned to abut with said head-mounting bracket whereby, as said first pivotable arm is pivoted about its eccentric path in abutment with said head-mounting bracket, said head-mounting bracket pivots about said coupling means.

8. The improvement in a print head carriage assembly of claim 7 wherein the coupling means includes a cylindered boss projecting from said top planar surface of the platform member and a circular aperture within said planar surface member of the head-mounting bracket and of a diameter substantially equal to the diameter of said cylindrical boss whereby said bracket is coupled to said boss about said aperture.

9. The improvement in a print head carriage assembly of claim 8 wherein the manifold adjustment means includes an oblong aperture within said planar surface member and aligned with said first shaft with the minor axis of said oblong aperture being substantially equal to the diameter of said first shaft.

10. The improvement in a print head carriage assembly of claim 9, wherein the platform member includes a pair of bearing seats about each end of said first channel, and including a pair of bearings with each bearing positioned in one of said bearing seats and making three-point contact with said seat whereby each bearing is pivotable about its respective bearing seat and thereby adapted to assume the axis of said first guide rail.

11. The improvement in a print head carriage assembly of claim 10 wherein the platform member comprises a first and a second carriage segment which are duplicates of one another and aligned in face-to-face abutting relationship, each of said first and second carriage segments having a central opening symmetrical about a longitudinal center line of the respective segment to form said central opening each of said first and second carriage segments forming a first groove extending laterally across the segment and normal to said longitudinal center line of the respective carriage segment to form said first channel, fastening means for fastening the first and second carriage segments in aligned face-to-face relationship, whereby the central opening provides clearance to receive said print head with said print head supported by one of said carriage segments and oriented with said print head normal to said platen so as to permit said print head to print upon said print medium.

12. The improvement in a print head carriage assembly of claim 11 wherein the carriage segments include means for anchoring carriage drive cables whereby the platform member may be moved along said guide track responsive to said drive cables.

13. The improvement in a print head carriage assembly of claim 12 further including:

a paper deflector member and a ribbon deflector member mounted to said head-mounting bracket and aligned with the terminal end of said print head.

14. The improvement in a print head assembly of claim 13 wherein the securing means further includes a coil spring member coaxial with said detent member and engaged about one end to said detent member and about the other end to said platform member, said coil spring urging said detent member towards said top planar surface of the platform member.

* * * * *